US011315533B2

(12) United States Patent
Pace et al.

(10) Patent No.: US 11,315,533 B2
(45) Date of Patent: Apr. 26, 2022

(54) KEYBOARD FOR WRITING MUSICAL SCORES

(71) Applicant: KEMONIA RIVER S.R.L., Palermo (IT)

(72) Inventors: Renato Pace, Palermo (IT); Alessandro Pace, Palermo (IT)

(73) Assignee: KEMONIA RIVER S.R.L., Palermo (IT)

( * ) Notice: Subject to any disclaimer, the term of this patent is extended or adjusted under 35 U.S.C. 154(b) by 45 days.

(21) Appl. No.: 16/954,654

(22) PCT Filed: Dec. 15, 2018

(86) PCT No.: PCT/IT2018/050247
§ 371 (c)(1),
(2) Date: Jun. 17, 2020

(87) PCT Pub. No.: WO2019/123499
PCT Pub. Date: Jun. 27, 2019

(65) Prior Publication Data

US 2020/0365124 A1 Nov. 19, 2020

(30) Foreign Application Priority Data

Dec. 19, 2017 (IT) ..... 102017000146502

(51) Int. Cl.
*G10G 3/04* (2006.01)
*G10H 1/00* (2006.01)
*G10H 1/34* (2006.01)

(52) U.S. Cl.
CPC ..... *G10G 3/04* (2013.01); *G10H 1/0008* (2013.01); *G10H 1/34* (2013.01); *G10H 2220/236* (2013.01)

(58) Field of Classification Search
CPC ..... G10G 3/04; G10H 1/0008; G10H 1/34; G10H 2220/236
(Continued)

(56) References Cited

U.S. PATENT DOCUMENTS 4,646,609 A * 3/1987 Teruo ..... G10H 1/0008 84/609
4,655,117 A * 4/1987 Roose ..... G10H 1/20 84/423 B
(Continued)

FOREIGN PATENT DOCUMENTS

CN 106991995 A * 7/2017 ..... G09B 15/023
DE 4028813 A * 3/1992 ..... G10G 1/02
(Continued)

*Primary Examiner* — Christina M Schreiber
(74) *Attorney, Agent, or Firm* — Abelman, Frayne & Schwab

(57) ABSTRACT

The invention relates to a keyboard (10) for writing musical scores, suitable for blind users, characterized by—an input module (12) connectible to a remote computer and provided with a plurality of keys divided into sets of keys, of which a first set of keys (30) is configured to generate signals representative of the pitch of the musical notes by a musical staff wherein the improvement comprises lines in relief that ensure tactile feedback and a second set of keys (40) is configured to generate signals representative of the duration of the musical notes;—a control unit (150) configured to translate sequences of pressed keys into corresponding signals to be sent to a remote computer, said signals being interpretable in terms of musical notation elements which can be represented on a computer.

20 Claims, 4 Drawing Sheets

(58) Field of Classification Search
USPC ..... 84/644
See application file for complete search history.

(56) References Cited

U.S. PATENT DOCUMENTS

| | | | | | |
|---|---|---|---|---|---|
| 5,088,378 | A * | 2/1992 | DeLaTorre | G10H 1/34 | 84/423 R |
| 5,151,873 | A * | 9/1992 | Hirsh | G06F 3/0219 | 708/172 |
| 5,153,829 | A * | 10/1992 | Furuya | G09B 15/002 | 379/110.01 |
| 6,605,767 | B2 * | 8/2003 | Fiks | G09B 15/002 | 84/402 |
| 8,822,803 | B2 * | 9/2014 | Terry | G10H 7/00 | 84/644 |
| 8,912,418 | B1 * | 12/2014 | Cohen | G10H 1/0091 | 84/483.2 |
| 9,082,386 | B1 * | 7/2015 | Cohen | G09B 15/02 | |
| 10,102,767 | B2 * | 10/2018 | Bayadzhan | G09B 15/023 | |
| 10,269,335 | B1 * | 4/2019 | O'Hair | G10H 1/386 | |
| 2003/0209130 | A1 * | 11/2003 | Anderson | G10H 1/34 | 84/443 |
| 2017/0243506 | A1 * | 8/2017 | Bayadzhan | G10G 1/00 | |
| 2020/0365124 | A1 * | 11/2020 | Pace | G10H 1/34 | |

FOREIGN PATENT DOCUMENTS

| | | | | |
|---|---|---|---|---|
| EP | 0164009 | A1 * | 12/1985 | G10H 1/0008 |
| EP | 2246833 | A1 * | 11/2010 | G10G 1/00 |
| GB | 2091019 | A * | 7/1982 | G09B 15/04 |
| JP | S62143997 | U * | 9/1987 | |

* cited by examiner

[Fig. 2]
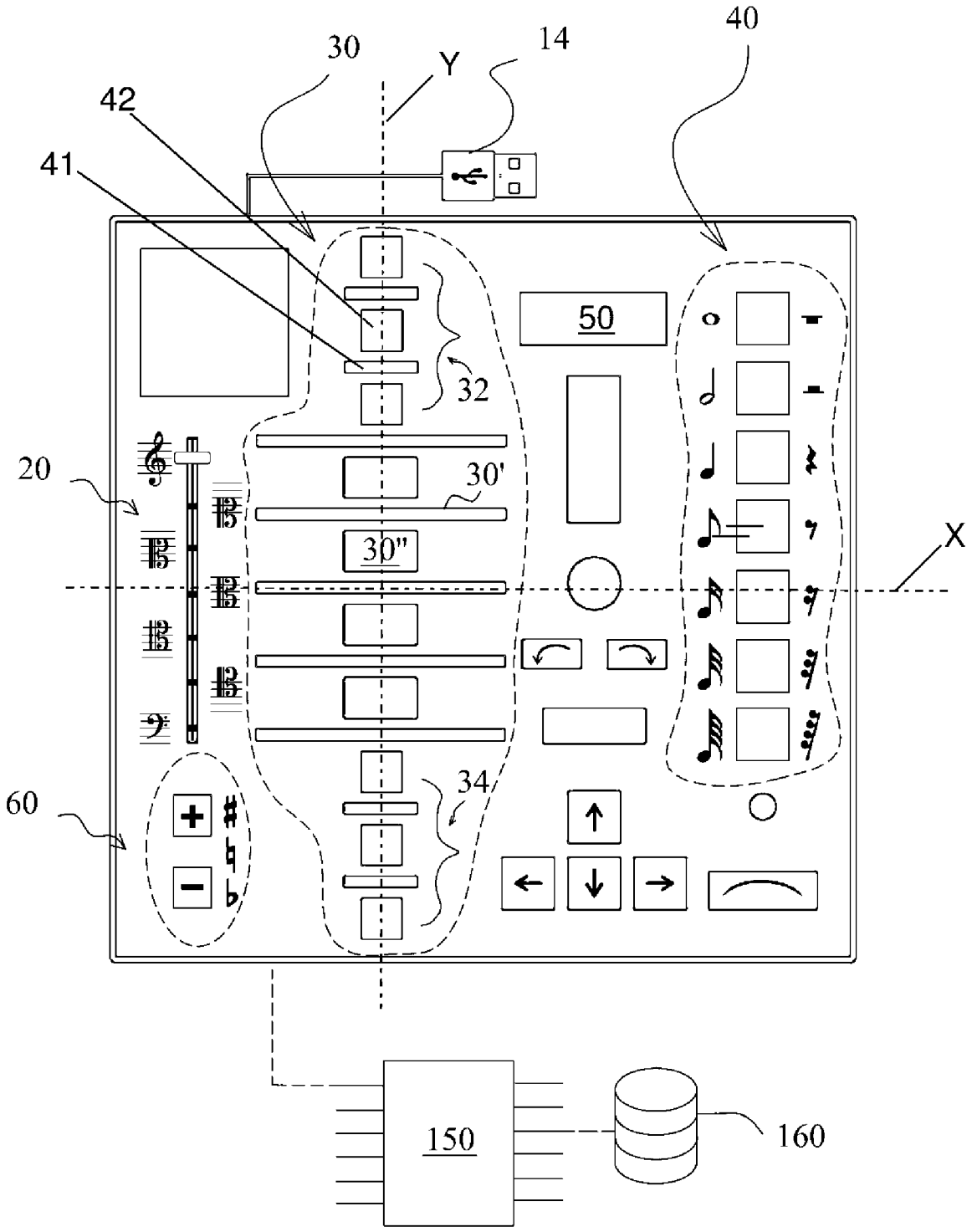

[Fig. 3]
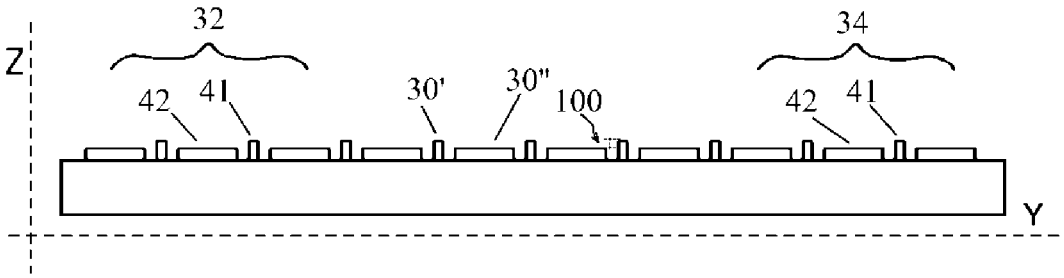
[Fig. 4]
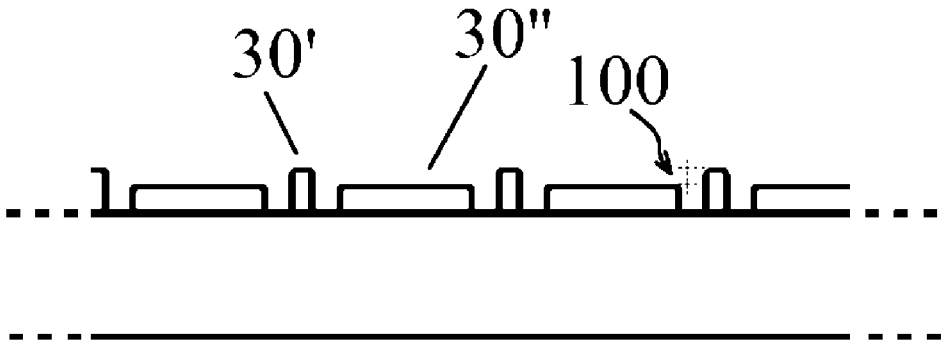

[Fig. 5]
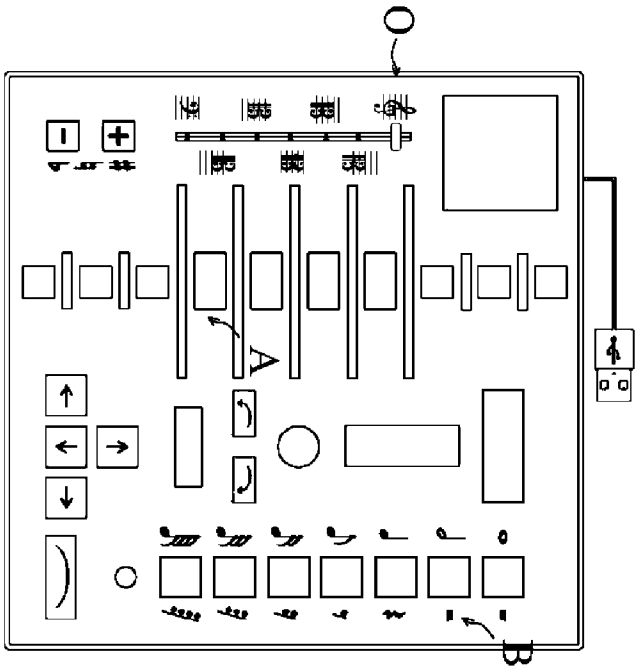
[Fig. 6]
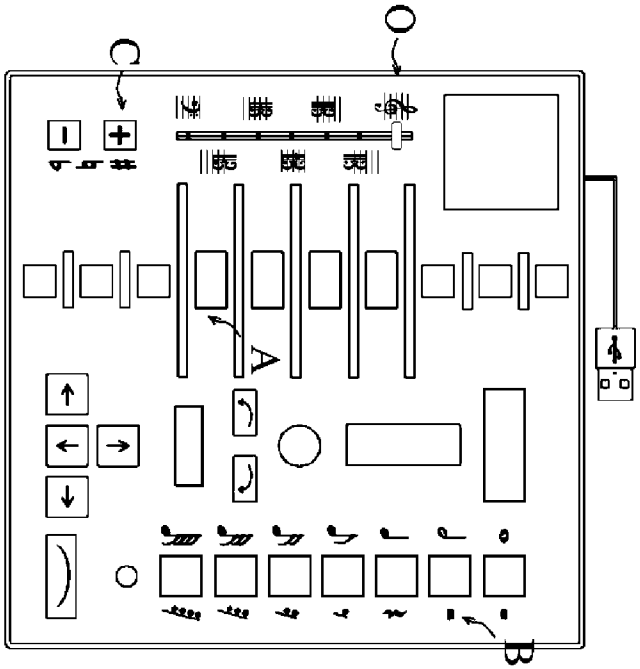

KEYBOARD FOR WRITING MUSICAL SCORES

CROSS REFERENCE TO RELATED APPLICATION

This application claims benefit under 35 U.S.C. § 371 to international application No. PCT/IT2018/050247 filed on Dec. 15, 2018, which claims priority to Italian application No. 102017000146502 filed Dec. 19, 2017, the contents of which are incorporated by reference in their entireties.

TECHNICAL FIELD

The present invention relates to a keyboard for writing musical scores whose purpose is to simplify the process of digital musical score writing. Its peculiar features make this invention also suitable for blind users.

BACKGROUND ART

It is well known that computer systems are generally constituted by a central computing unit connected to different input and output devices that provide a suitable interface for human beings. The purpose of the user interface is to enable a human being to interact with a computer in a natural way. The various input/output devices of the system are therefore involved into a bidirectional process of converting human language into machine instructions to accomplish the desired task, the results of which are then made comprehensible to humans with the reverse translation process.

Musical notation is a set of rules that apply to music writing world-wide, because through the centuries, it has been standardized in a universally acknowledged symbols system. Other music writing systems exists, whose use is however limited to specific areas (tablatures, electronic music, contemporary, oriental, etc.) that do not concern the context of this invention.

The classical musical notation, like any other writing system, uses a set of graphic symbols arranged in a form that conveys a meaningful content. Compared to the semiology of the Western spoken languages which requires a few dozen of signs, typically representable in a classical QWERTY keyboard or similar, the transcription of music in a graphical form requires, as can be easily understood for the complexity, variety and multiplicity of matter, an extremely multifaceted and articulated set of elements for the representation of sound. Among all the categories of musical attributes, however, two prevail in terms of semantic relevance: the one that indicates the precise "pitch" of the sound and the one that represents its "duration". These two sound features, in musical notation, are represented both at the same time in a single sign, the "Note".

Unlike the individual letters of the alphabet, where each grapheme is generally associated to one phoneme, the note has a composite meaning indicating the "Duration" of the sound and, at the same time, also its "Pitch". The duration is denoted by the graphic symbol used and the pitch is given by its placement within a set of five horizontal lines, known as staff. The staff represents a limited range, variable from grave to acute registers, of all sounds used in music.

Apart this basic rule of composition, the musical notation comprises numerous other symbols to describe the various elements of the complex structure of a piece of music, some with mathematical precision, others with sufficient approximation.

Starting from this assumption, it is clear the importance of the design principles used for the implementation of effective input interfaces for computer-assisted musical writing.

At the state of the art, the main music notation software provide a variety of input methods, among which the user can choose the preferred one. These methods are divided into three categories, each related to the use of a specific input device:

1. A mouse to simulate on the screen the traditional handwriting on the score sheet.
2. A QWERTY keyboard whose individual keys, or combination of keys, corresponds to a specific music symbol, that may vary according to the current settings configuration exposed by the software through the use of dedicated menus and dialogs.
3. MIDI (Musical Instrument Digital Interface) input devices, compliant to a standard communication protocol for electronic music instruments, especially designed for the automatic execution of a music score. The pitch and duration of each note, and several other information regarding the proper execution, constitutes part of the content of the protocol messages.

On the basis of the above written considerations, it is clear that the methods currently provided for musical writing with the aid of a computer are neither optimal nor fully accessible in general, especially to blind users.

The three categories of input devices described above imply for the user the dependence on the visual feedback provided by the computer screen (continuously in the first case, at times but still frequently in the other two), in an interactive process that is prohibitive for a blind person.

During the research on input methods suitable to blind people, as provided by several musical writing programs, it emerged that, at the current state of the art, these tools are lacking effectiveness and ease of use also for non-disabled users. In general, the function of a user interface should be, indeed, to extend the capabilities of human interaction to the use of a computer device in the most natural way, that for the purpose at hand, translates in to the ability of simulating the manual writing of sheet music.

The first category of devices described above is undoubtedly the closest to the human interaction model but is, however, tricky and uncomfortable in the general case, and totally inaccessible to a blind person. The other two categories are mediated by devices completely detached from the human experience of writing directly on staves.

The experience of writing on the staff has been recently reproduced in an optimal manner through the use of devices equipped with touch screens, however, apart being complex and expensive devices, they are completely useless for blind people. Besides, with reference to typhlological instruments, that is tools designed to overcome the problems of people with visual impairment (blind and visually impaired), it should also be noted that, nowadays, the use of normal computer keyboards is overcoming the use of "braille" input devices.

In this context, with regards to the usability by blind people, the research of the inventors has highlighted that the majority of the solutions, both software and hardware, adopt a hierarchical and taxonomical organization of the available features that transposes into the navigation of several menus, submenus and windows, for the selection of the desired function, resulting in a complex multi-step procedure, often impossible to follow for a blind person.

At the background art, there are no input devices that can be used by a blind musician to transcribe musical notes directly on a staff.

SUMMARY OF INVENTION

The purpose of the present invention is to provide an input method for the editing of musical scores, suitable for informative systems, through the use of a new hardware device that integrates with pre-existing music notation software or new ones, realized ad hoc.

Another goal consists in improving the accessibility features of these software for blind people and, as a consequence of its ease of use and simplicity, to make it a tool suitable also for the professional musician in general, whether disabled or not.

These and other purposes are achieved, in particular, by a keyboard for writing musical scores, the keyboard comprising:

an input module provided with a plurality of keys divided into sets of keys, of which a first set of keys is configured to generate signals representative of the pitch of the musical notes by a musical staff wherein the improvement comprises lines in relief that ensure tactile feedback and a second set of keys is configured to generate signals representative of the duration of the musical notes;

a control unit configured to translate sequences of pressed keys into corresponding signals to be sent to a remote computer, said signals being interpretable in terms of musical notation elements which can be represented on a computer.

Preferably, the transmissions of signals should be sequential, meaning a direct relation between the key pressed and the corresponding signal.

One of the advantages of this solution is to provide set of keys dedicated to the input of a single musical symbol, that being physically grouped by category also constitutes a tactile system.

This system, conceived to meet typhlologic needs in order guarantee a high level of integration in social and cultural activities, results in a practical and effective tool because of its simple and immediate interaction model also in the general case.

According to the present invention, the keys belonging to the first set of keys are divided into a first subset of keys representing the five lines of the staff in a three-dimensional shape identifiable by touch and into a second subset of keys representing the spaces comprised between the lines of the staff, said keys being in relief.

This arrangement of the keys, combined with the appropriately diversified dimensions of each subset of keys and with the protruding, also diversified, of the key with respect to the level of the key-holding plane along the Z axis, produces the three-dimensional graphics of the staff. This three-dimensional shape is essential to the blind users for his orientation on the staff through tactile perception.

One of the advantages of this solution consists in the fact that the alternance of embossed keys provides a tactile feedback for both blind and non-blind users, who can interact with the device without the need of a visual feedback for the position of the fingers on the keyboard.

All the other keys of the second group of the keyboard, together with the control unit, have a complementary function with reference to the pitch signals generated by the keys of the first group, that are three-dimensionally representative of the staff. Their use is related especially to the definition of the duration of the notes but is also extended to the general purposes of editing and the management of musical writing and more.

The three-dimensional shape of the staff can be considered new because it is not included in the background art: in the rare cases of input devices in which the representation of the staff is provided, the latter is always as two-dimensional type, i.e. drawn on the keyboard for purpose of visual guide for the users from which, therefore, sightless are excluded. Other features of the invention can be derived from the related claims, that describe specific implementation details of the invention.

BRIEF DESCRIPTION OF DRAWINGS

Further features and advantages of the invention will be clear reading of the following description provided as a non-limiting example, with the aid of the figures shown in the attached tables, in which.

Figure 1:
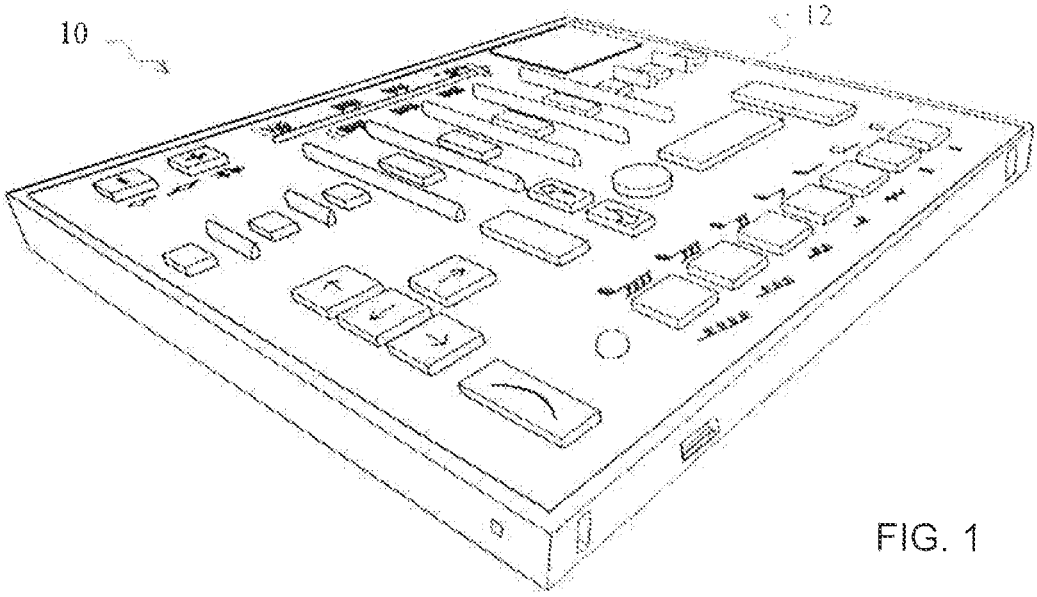
FIG. 1 illustrates a keyboard for writing musical scores according to an embodiment of the invention in perspective view.

FIG. 2 illustrates a top view of the keyboard of FIG. 1;

FIG. 3 illustrates a side view of the keyboard section according to the Y axis;

FIG. 4 illustrates an enlarged detail of FIG. 3;

FIG. 5 illustrates a first example of use of the keyboard of the invention;

FIG. 6 illustrates a second example of use of the keyboard of the invention.

DESCRIPTION OF EMBODIMENTS

The invention will now be described with initial reference to FIG. 1, to FIG. 2, to FIG. 3 and to FIG. 4 under the premise that the present invention falls within the general category of the input devices that can be connected to the computer, such as a QWERTY keyboard.

The invention, in particular, refers to a hardware specifically dedicated to input in an information system all the informative contents useful to create a musical score, said hardware being configured in the form of a keyboard 10.

The keyboard 10 is characterized by the presence in relief of a first group 30 of keys, representative of a staff, and pressure-sensitive and a second group 40 of keys to enter the information required for basic musical writing, in particular but not only for the input of the duration of the musical notes or the duration of the rests.

The keyboard 10 is preferably usable with a software designed to perform the appropriate translation of the inputs transmitted to a computer through the keyboard 10 for the major music notation software present at state of the art.

As indicated previously, the keyboard 10 is characterized by the presence in relief of a pressure sensitive staff and by another series of keys that allow the input of other elements of musical notation.

Preferably, but not exclusively, the keyboard 10 (FIGS. 1 and 2) may have a squared shape of about 15 cm on each side.

The keyboard 10 has on the surface a staff sensitive to the pressure, with tactile feedback and sized in a manner suitable to be activated by the fingers tips.

In particular, the keys belonging to the first group 30 of keys representing the staff are in turn divided into 30' keys, which form a first subgroup that represents the lines of the staff, and in 30" keys, which form a second subgroup representing the spaces between the lines of the staff.

The keys of the first group 30 are aligned along a Y axis. In particular, it is preferable that the key centers of the first group 30 are aligned along the Y axis. The X axis shown in FIG. 2 is perpendicular to the Y axis.

Preferably, the distance according to the Y axis between the keys 30' is suitable to facilitate their identification by touch as representative of lines of a staff.

Furthermore, it is preferable that this distance according to the Y axis between the keys 30' is suitable for hosting a key for representing the spaces of a staff.

The 30' keys are alternated with the 30' keys. In particular, a 30" key is included, preferably directly included, between two keys 30'. Preferably, the first sub-group of keys consists of five first keys all having the same width parallel to the axis (X), the same height parallel to the axis (Y) and the same projection parallel to the axis (Z); preferably the second subset of keys 30" consists of four second keys all having the same width parallel to the axis (X), the same height parallel to the axis (Y) and the same projection parallel to the axis (Z).

The keys 30' have a width, parallel to the X axis, greater than the 30" button width. Preferably, the width of the keys 30' is at least twice the 30" button width.

Furthermore, it is preferable that the keys 30' have a height, parallel to the Y axis, lower than the height of the 30" keys. Preferably, the height of the 30" keys is at least twice the height of the 30' keys.

It is preferable that the keys 30' have a projection, parallel to the axis (Z) greater than the projection of the keys 30", and that such protruding 100 is suitable to facilitate identification by touch of keys 30' as representative of staff lines.

The protrusion along the Z dimension of the keys (30') and (41) should be preferably big enough with reference to the surface of the device to be perceptible by touch;

The protrusion along the Z dimension of the keys (30') and (41) should be preferably greater that the height along the same Z axis of the keys (30") and (42) and sufficient to guarantee that pressing the keys (30') e (41) will not result in accidental pressing of the keys (30") and (42);

Preferably, the first group of keys 30 also includes two further sub-groups of keys 32, 34.

Subgroup 32 is arranged above the first subset of keys 30' and the second subset of keys 30".

The key subgroup 34 is arranged below the first subset of keys 30' and the second subset of keys 30".

Preferably, the key subgroup 32 and the key subgroup 34 are each consisting of five keys, of which two keys 41 have the same size and another three keys 42 have the same size but different from the 41 keys.

The keys 41 represent the ledger lines of a staff and are used to insert notes arranged on additional lines of the staff. The keys 42 are used to insert notes in additional spaces of the staff.

It is preferable that the distance, according to the Y axis, between the keys 41 is suitable to facilitate their identification by touch as representative of the "ledger lines" of a staff.

Furthermore, it is preferable that this distance according to the Y axis between the keys 41 is suitable for hosting a key for representing the "ledger spaces" of a staff.

It is preferable that the keys 41 have a projection, parallel to the axis (Z) greater than the projection of the keys 42, to recognize them by touch as a ledger lines of a staff.

The keys 41 have a width, along the X axis, greater than the width of the keys 42. Furthermore, the keys 41 have a width smaller than the width of the keys 30' and the 30" keys. Preferably, the keys 41 have a height, along the Y axis, equal to the height of the 30' keys. Preferably, the keys 41 have a lower height at the keys 42. The keys 42 preferably have a height equal to the height of the keys 30".

Preferably, but not exclusively, the keys of the group 30 have substantially the shape of a parallelepiped. Alternatively, the keys 30' and the keys 41 have substantially the shape of a triangular prism, and the keys 30' and the keys 42 have substantially the shape of a parallelepiped, preferably with a squared base. Preferably, when the keys 30' and the keys 41 have substantially the shape of a triangular prism, the upper edge is beveled, the upper edge being the edge that extends parallel to the X axis and intended to come into contact with the finger, or fingers, of the user.

Preferably, but not exclusively, the keys of group 40 have substantially the shape of a parallelepiped, preferably with a squared base.

Module 12 also presents a series of keys dedicated to the main inputs of musical writing elements grouped in taxonomic order and a selector 20, which is preferably a slider, of clef for the selection of the appropriate register of the staff.

This slider generates the signal that codify the information relative to the clef, that is essential for the interpretation, in terms of pitch, of the signal generated by any of the keys of the group 30.

The clef in use is determined by the position of the slider 20; moving the slider to one of the fixed steps produces a tactile feedback for blind users.

Anyway, the slider functions can be implemented in the keyboard management software.

In particular, whereas, instead of a note value, you want to enter one rest of the same duration, you can use the key 50 that works as a sort of backspace and serves to transform, when necessary, the note just entered, in a rest of the same duration, as noted by the correspondence of the graphic signs on to the right of the column of group 40 of keys for the selection of the duration of the note. Preferably, the key 50 is arranged next to and aligned with the top button of group 40. This position is convenient because it makes it easily identifiable, being the key 50 typically used very often.

The key 60 is used to apply alteration to notes, that is the pressure of the key + and − respectively increment or subtract a semitone to the note just entered automatically adding the sign of the alteration sharp, flat or natural, according to the tonal context in which it is operating.

The keyboard 10 is equipped with USB 14 output for connection to a computer (not represented for simplicity).

Other forms of connecting the keyboard 10 to the computer may be related to wireless technologies.

The keyboard 10 also comprises a control unit 150. Preferably, the control unit is adapted to transform the interruption of the matrix circuit into signal to be sent to a separated computer device. Optionally, the keyboard 10 includes also a memory module 160 suitable for storing data. Preferably, the memory module 160 is associated with the control unit 150. The keyboard 10 is preferably usable with software that, installed on the computer in use, makes the keyboard itself compatible with the main programs currently available for the musical writing on computers. This software to be used with the 10 keyboard is preferably a macro recorder, designed in particular for the automation of command sequences. This software can interact with another software dedicated to musical notation, for example those freely or commercially available, such as Sibelius, MuseScore or Finale.

With regard to the internal operating system, the keyboard 10 acts basically like a QWERTY keyboard or similar: both the single key and the positioning of the selector slider represents a switch set to close/open the circuit at a certain point of a circuit matrix. The collocation of the switch on matrix determines the signal sent to the microprocessor of the internal control unit 150 for the encoding and communication to the PC, via USB, of the key currently pressed.

The specific software associated with the invention interprets the key pressed as a PC keyboard shortcut necessary to obtain, on the notation program in use, the desired element of musical notation.

Operating on the keyboard 10, the key selector 20 is supposed to be used first. In particular, the key selector 20 is used to decide the music register between acute, grave and various intermediate levels, within which the pressure of a key of group 30 assumes a particular meaning, respectively different, to be sent to the PC to indicate the height of the note.

Once the clef used to to write the musical notation is selected, it is possible to start writing the score itself.

Naturally, the key selector 20 can be moved from one position to the next whenever it is needed to record notation for another instrument: for example writing musical score suitable for violin or for other instruments that belong to the high register, the switch 20 can be set on the treble clef to continuously enter additional notes without having to move the selector 20 lever further. If then, for example, it is required to enter notation for the double bass, or for others instruments of the grave range of sounds, the selector 20 can be set on the bass key (the last one at the bottom in FIG. 2) and then, the user can continue to write the notes. The other positions of the selector 20 are used to set the signals generated from the group 30 into intermediate registers.

EXAMPLE 1

FIG. 5 illustrates a first use case for the keyboard of the invention.

Once the desired key (phase 0 in FIG. 5, set in treble clef) to enter the notes is selected, it is possible to proceed, for example, to insert a Sol (G4 in Anglo-Saxon scientific notation) with a duration of 4/4.

The user presses the key in group 30 that corresponds to the desired displacement of the note in the staff. In the example shown, the G4 note is written on the second line of the staff and therefore this key, which is a key in the sub-group of keys 30', must be pressed (phase A in FIG. 5).

Immediately after, the user can press the key corresponding to the duration of 4/4 in group 40 of keys for the selection of the duration of the note in the staff (phase B in FIG. 5).

This key also works as a data validation key in order to speed up the data writing operations.

At this point the keyboard 10 sends this data to the dedicated software installed in the computer. The dedicated software processes the data received and sends them in a significant form to the music score software used on the same computer, which will directly write the note G4.

If in this Example 1, at phase 0, the selector was set on the key low (last lower position) and not on the violin (the first position at the top, as in FIG. 2), the same procedure reported in the first part of EXAMPLE 1 and, in particular, the pressure of the same key indicated in FIG. 2 as phase A would have as a final result, the writing of note B2.

Whereas, instead of the duration of a note, you want to insert a pause of the same duration, the key 50 is used, which as previously said serves to transform, when necessary, the note just entered, in a pause of the same duration indicated to the right of the duration selection keys column of the note.

EXAMPLE 2

FIG. 6 illustrates a second use case for the keyboard of the invention.

With reference to the alterations, suppose the user want to insert in F sharp (F #4) of duration 2/4 in treble clef, or assuming that the key selector is already in the position of the treble clef (phase 0 in FIG. 6).

The key corresponding to the F4 is then pressed in the group of keys 30 for the displacement of the note in the staff. In the example shown, F4 is written in the space between the first and second line of the staff and then the corresponding key, which is a key in the sub-group of keys 30", will have to be pressed (phase A in FIG. 6).

Immediately after, the user presses the key corresponding to the duration of 2/4 in group 40 of keys for choosing the duration of the note in the staff (phase B in FIG. 6).

To apply an alteration, as indicated above, the appropriate key is pressed between the two keys of group 60, I.e. the pressure of the + and − key respectively increments o decrements the note value just entered of a semitone adding automatically the sign of alteration. In this case, the key indicated by the + sign should be pressed, which will produce the final result of transforming the F4 into F #4 (phase C in FIG. 6).

In general, using the keyboard 10 of the invention, is similar to text writing: after some writing operation the user checks the generated contents. Given the complexity of musical writing and also the complexity of editing and correcting possible errors, however, a higher frequency for the check is recommended compared to that of writing a text. Contents validation can be done thought visual feedback on the screen, or for blind users, listening to the score playback.

Still, in general, the keyboard 10 of the invention provides a control unit 150 configured to translate key strokes into corresponding signals to be sent to a remote computer, said signals being interpretable, by software dedicated installed in the computer, in terms of elements of musical notation representable on computers.

A sequence of key strokes may consist of one or more keys pressed sequentially.

Obviously, modifications and improvements may be applied to the invention as described above, dictated by contingent or particular motivations, without going out from the scope of the invention as claimed below.

The invention claimed is:

1. A keyboard for writing musical scores, comprising:

an input module connectible to a remote computer and provided with a plurality of keys divided into sets of keys, of which a first set of keys is configured to generate signals representative of pitch of the musical notes in a musical staff and a second set of keys is configured to generate signals representative of the duration of the musical notes;

a control unit configured to translate sequences of pressed keys into corresponding signals to be sent to a remote computer, said signals being interpretable in terms of musical notation elements which are selectively represented on the remote computer;

wherein the keys belonging to the first set of keys are aligned along a first axis (Y), and are divided into a first subset of keys representing the five lines of the musical staff in a three-dimensional shape identifiable by touch, and into a second subset of keys representing the spaces comprised between the lines of the musical staff;

wherein the keys of the first subset of keys are alternated with the keys of the second subset of keys;

wherein the first subset of keys comprises or consists of five first keys all having the same width parallel to a second axis (X), the same height parallel to the first axis (Y) and the same projection parallel to a third axis (Z);

wherein the second subset of keys comprises or consists of four second keys all having the same width parallel to second axis (X), the same height parallel to the first axis (Y) and the same projection parallel to the third axis (Z); and wherein the first keys have a width, parallel to the second axis (X), greater with respect to the width of the second keys.

2. The keyboard according to claim 1, wherein the first keys have a height, parallel to the first axis (Y), lower with respect to the height of the second keys.

3. The keyboard according to claim 2, wherein the first keys have a projection, parallel to the third axis (Z) greater with respect to the projection of the second keys.

4. The keyboard according to claim 1, wherein there are provided a third subset of keys and a fourth subset of keys, wherein the third subset of keys is arranged above the first subset of keys and the second subset of keys; and wherein the fourth subset of keys is arranged below the first subset of keys and the second subset of keys.

5. The keyboard according to claim 4, wherein the third subset of keys and the fourth subset of keys each comprise two third keys all having the same width parallel to the second axis (X), the same height parallel to the first axis (Y) and the same projection parallel to the third axis (Z); and three fourth keys all having the same width parallel to the second axis (X), the same height parallel to the first axis (Y) and the same projection parallel to the third axis (Z).

6. The keyboard according to claim 5, wherein the third keys have a height, parallel to the first axis (Y), which is lower than the height, parallel to the first axis (Y), of the fourth keys; wherein the third keys have a width, parallel to the second axis (X), which is greater than the width, parallel to the second axis (X), of the fourth keys.

7. The keyboard according to claim 6, wherein the third keys have a projection, parallel to the third axis (Z) which is greater than the projection of the fourth keys.

8. The keyboard according to claim 7, wherein the third keys have a width, parallel to the second axis (X), which is lower than the width, parallel to the second axis (X), of the first keys.

9. The keyboard according to claim 1, wherein there is provided a slider which can be used to select the desired musical clef.

10. The keyboard according to claim 1, wherein the keys belonging to the first set of keys project upwardly a predetermined length above an upper surface of the keyboard.

11. A keyboard for writing musical scores, comprising:

an input module connectible to a remote computer and provided with a plurality of keys divided into sets of keys, of which a first set of keys is configured to generate signals representative of the pitch of musical notes in a musical staff and a second set of keys is configured to generate signals representative of the duration of the musical notes;

a control unit configured to translate sequences of pressed keys into corresponding electronic signals, the control unit being configured for electronic communication with a remote computer, said electronic signals being interpretable in terms of musical notation elements which are selectively represented on the remote computer;

wherein the first set of keys are aligned along a direction of a first axis (Y), and are divided into a first subset of keys representing the five lines of the musical staff in a three-dimensional shape identifiable by touch, and into a second subset of keys representing the spaces formed between the lines of the musical staff;

wherein the keys of the first subset of keys are alternated with the keys of the second subset of keys;

wherein the first subset of keys comprises five first keys all having a predetermined width extending in a direction of a second axis (X) which is perpendicular to the first axis (Y), a predetermined height in the direction of the first axis (Y) and a predetermined projection in a direction of a third axis (Z) which is perpendicular to the first axis (Y) and the second axis (X);

wherein the second subset of keys comprises of four second keys all having a predetermined width in the direction of the second axis (X), a predetermined height in the direction of the first axis (Y) and a predetermined projection in the direction of the third axis (Z); and wherein the width of the first keys of the first subset of keys is greater than a width of the second keys of the second subset of keys.

12. The keyboard according to wherein the height of the first keys is less than the height of the second keys.

13. The keyboard according to claim 12, wherein the projection of the first keys is greater than the projection of the second keys.

14. The keyboard according to claim 11, wherein the first set of keys includes a third subset of keys and a fourth subset of keys, the third subset of keys being arranged above the first subset of keys and the second subset of keys in the direction of the first axis (Y); and the fourth subset of keys being arranged below the first subset of keys and the second subset of keys in the direction of the first axis (Y).

15. The keyboard according to claim 14, wherein the third subset of keys and the fourth subset of keys each comprise: two third keys all having a predetermined width in the direction of the second axis (X), a predetermined height in the direction of the first axis (Y) and a predetermined projection in the direction of the third axis (Z); and three fourth keys all having a predetermined width in the direction of the second axis (X), a predetermined height in the direction of the first axis (Y) and a predetermined projection in the direction of the third axis (Z).

16. The keyboard according to claim 15, wherein the height of the third keys is less than the height of the fourth keys; the width of the third keys is greater than the width of the fourth keys;

and the projection of the third keys is greater than the projection of the fourth keys.

17. The keyboard according to claim 16, wherein the width of the third keys is less than the width of the first keys.

18. The keyboard according to claim 11 further including an actuator for selecting a desired musical clef.

19. The keyboard according to claim 11, wherein the actuator is a slider.

20. The keyboard according to claim 11, wherein the keys of the first set of keys project upwardly a predetermined length above an upper surface of the keyboard.

* * * * *